United States Patent [19]

Arakawa et al.

[11] Patent Number: 4,576,007

[45] Date of Patent: Mar. 18, 1986

[54] METHOD AND APPARATUS FOR CONTROLLING AN OPERATION OF PLANT

[75] Inventors: Tadao Arakawa; Takeshi Ueno; Hiroshi Tsunematsu; Keiichi Toyoda; Tsuguo Hashimoto, all of Hitachi, Japan

[73] Assignees: Hitachi, Ltd.; Hitachi Engineering Co., Ltd., both of Tokyo, Japan

[21] Appl. No.: 716,150

[22] Filed: Mar. 26, 1985

[30] Foreign Application Priority Data

Mar. 26, 1984 [JP] Japan ..... 59-55991

[51] Int. Cl.[4] ..... F01K 13/02

[52] U.S. Cl. ..... 60/660; 60/652; 60/657; 60/665; 60/667

[58] Field of Search ..... 60/646, 657, 660, 652, 60/667, 665

[56] References Cited

U.S. PATENT DOCUMENTS 4,345,438 8/1982 Labbe et al. ..... 60/660 X

*Primary Examiner*—Allen M. Ostrager

*Attorney, Agent, or Firm*—Antonelli, Terry & Wands

[57] ABSTRACT

An apparatus for controlling an operation of a turbine plant on a reduction of the load on a turbine operates to compute a saturation pressure corresponding to the temperature in the downcomer pipe by using the detected values representing the conditions of the plant, and to control the reduction of the turbine to maintain the pressure in the downcomer pipe higher than the computed saturation pressure so as to prevent an occurrence of flashing.

18 Claims, 5 Drawing Figures

METHOD AND APPARATUS FOR CONTROLLING AN OPERATION OF PLANT

BACKGROUND OF THE INVENTION

The present invention relates to a method and an apparatus for controlling an operation of turbine plant, and more particularly for preventing a flashing when the load on the turbine is decreased abruptly.

The turbine plant is used widely for the purpose of electric power generation. In connection with the electric power demand, the turbine is not always required to operate with full power, but required to operate with full power in the daytime to meet a large demand for electric power and to stop or operate with partial load in the night time in which the demand for electric power is rather small. Such alternation of start and stop of operation in one day or partial load operation imposes a problem that the flashing occurs in the deaerator or in the boiler feedwater pump when the power is decreased in conformity with a reduction in the load level. Such flashing adversely affects the control of operation of the plant.

The reason why the flashing occurs is as follows. When the load of the turbine is decreased abruptly, the interior pressure in the deaerator, to which the heated steam is supplied from the turbine, is also decreased. On the other hand, when the load of the plant is decreased below a predetermined level, the feedwater pump is stopped and the hot water in the downcomer pipe remains high temperature. Consequently, the interior pressure in the downcomer pipe becomes lower than the saturated vapour pressure corresponding to an inlet temperature, thus the flashing is occurred in the deaerator and the downcomer pipe. It is also experienced that re-starting of the feedwater pump is often failed because the pump suction head is lowered as a result of the flashing.

Although various proposals have been made to overcome the above-described problems, these proposals are confined to control the plant partially, and no attempt has been made to control the whole plant. For instance, Japanese Patent Laid-Open Publication No. 143103/1976 discloses one proposal to prevent an occurrence of flashing in the downcomer pipe connecting a deaerator to the feedwater pump.

When a main turbine is tripped from 100% load, the downcomer pipe is filled with hot water of the same temperature as the hot water in the deaerator on 100% load, so that flashing occurs in the downcomer pipe. According to the proposal, in order to prevent the occurrence of flashing, the hot water in the downcomer pipe is fed to the boiler through a branch pipe upon such turbine trip so as to remove the hot water remaining at the inlet side of the feedwater pump. Accordingly the occurrence of flashing is prevented even when the condensate in the deaerator, the temperature of which has been lowered due to the turbine trip, reaches the inlet side of the feedwater pump.

According to this arrangement, however, the hot water cannot be sufficiently removed from the downcomer pipe through the branch pipe in response to a reduction in the turbine load and, therefore, the temperature in the downcomer pipe cannot be lowered in response to the turbine load reduction. With this countermeasure, it is not possible to perfectly avoid the occurrence of flashing.

SUMMARY OF THE INVENTION

Accordingly, an object of the invention is to provide a method and an apparatus for controlling an operation of a turbine plant having a deaerator, a feedwater pump and a downcomer pipe connecting them, which is capable of eliminating flashing and other related troubles which may occur when the load level on the turbine is changed, and of ensuring a high efficiency of the operation.

To this end, according to the invention, an automatic computing means receives data such as the measured turbine load and the measured pressure and temperature in the downcomer pipe, as well as the demands such as the level to which the load is to be lowered and the time duration in which the lowering of the load is to be completed, and computes the desirable load reduction manner which will not cause any flashing. Then, the load on the turbine is reduced in accordance with the computed manner. In other words, the turbine is so controlled that the turbine load is reduced while remaining the pressure in the downcomer pipe higher than the saturation vapor pressure corresponding to the temperature of the hot water in the downcomer pipe, such as to avoid occurrence of flashing due to the reduction in the pressure in the deaerator and high temperature of the hot water in the downcomer pipe.

DETAILED DESCRIPTION OF THE PREFERRED EMBODIMENTS

Figure 1:
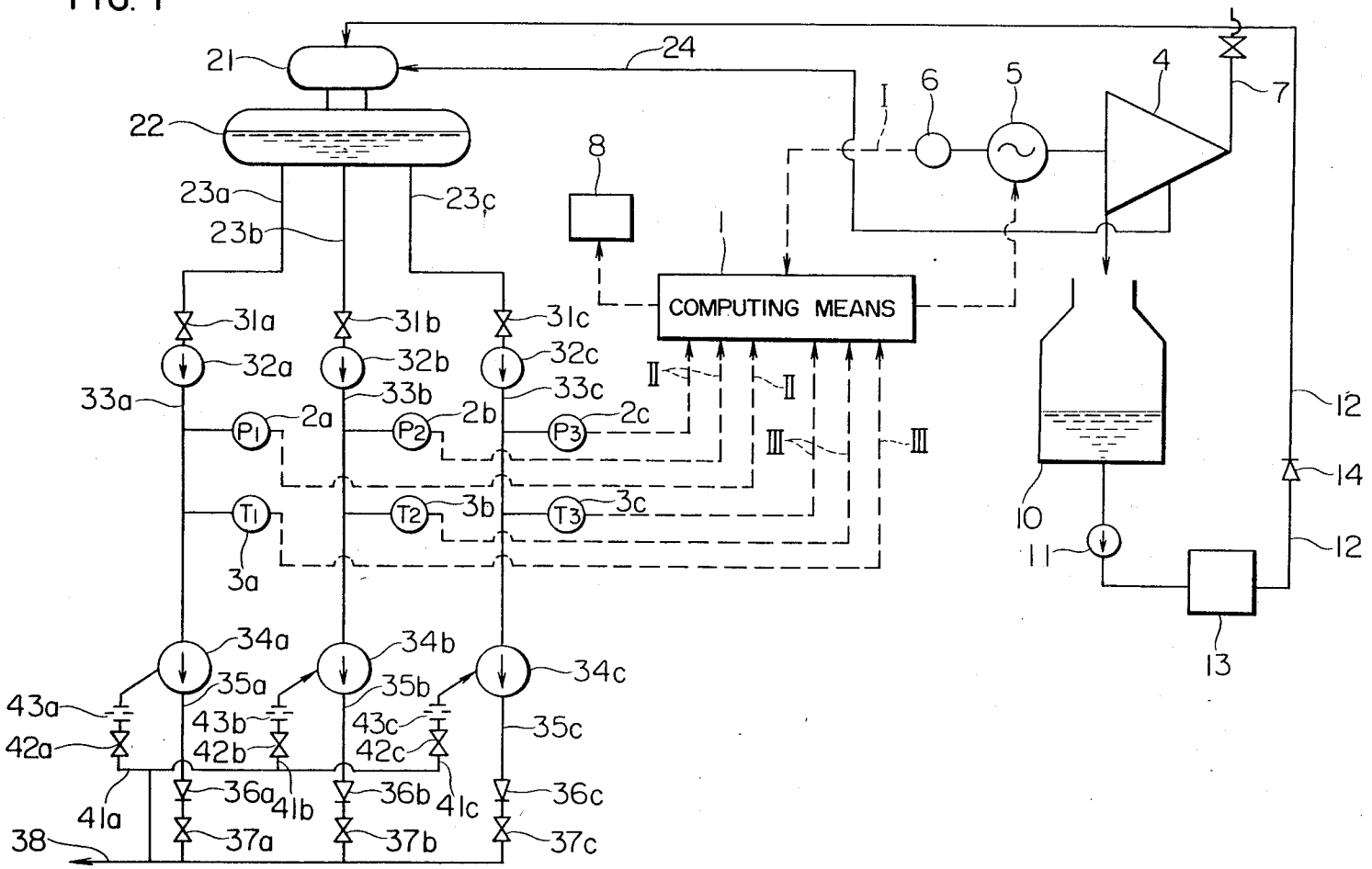
FIG. 1 is a system diagram of a turbine plant to which an embodiment of the invention is applied.

Referring to FIG. 1, the condensate is delivered from a condenser 10 to a deaerator 21 through a condensate pipe 12. The condensate is temporarily stored in a tank 22 and then is forwarded to a feedwater pump system. In the illustrated case, the feedwater pump system has three subsystems which are suffixed by a, b and c, respectively. These three sub-systems will be referred to as groups A, B and C, respectively, hereinunder. These groups A, B and C have feedwater pumps 34*a*, 34*b* and 34*c*, respectively.

The feedwater pumps 34*a* and 34*b* of the groups A and B have capacities amounting to 50% of the rated capacity of the respective boilers. On the other hand, the feedwater pump 34*c* of the group C has a capacity amounting to 25% of the rated capacity of the corresponding boiler. These three groups A, B and C in combination constitute a boiler feedwater system.

During the operation of the plant, the condensate is pumped by a condensate pump 11 from the condenser 10 to the deaerator 21 through the condensate pipe 12, feedwater heater 13 and a check valve 14.

The condensate in the deaerator 21 is heated and deaerated by a heated steam from a steam pipe 24, and is temporarily stored in the tank 22. The condensate is then supplied to the boiler feedwater system through downcomer pipes 23*a*, 23*b* and 23*c*. The group A in the boiler feedwater system has a series connection of a booster pump inlet valve 31*a*, a booster pump 32*a*, feedwater pump suction pipe 33*a*, a feedwater pump 34*a*, a feedwater pump discharge pipe 35*a*, a check valve 36*a* and a feedwater pump outlet valve 37*a*. The feedwater pump outlet valve 37*a* is connected at outlet side thereof to a header 38 which is common to three groups A, B and C. A line having a series connection of a warming pipe 41*a*, a warming valve 42*a* and an orifice 43*a* is disposed between the header 38 and the feedwater pump 34*a*. Other groups B and C are constructed substantially in the same forms as the group A.

When the load on the plant is greater than 50% of the rated load thereof, the feedwater pumps 34*a* and 34*b* operate while the feedwater pump 34*c* does not operate. However, when the load on the plant is below 50% of the rated load thereof, either one of the feedwater pumps 34*a* and 34*b* operates, while the other is used as a back-up. In this system, the pressure and the temperature of the water at the inlet of the feedwater pump are measured as the pressure and the temperature in the down comperpipe.

The controlling apparatus according to the invention applied to this steam turbine plant has a load detecting means for detecting the data I which represent the level of the load on the turbine. In this case, the load detecting means includes a load signal transmitter 6 which is provided on the generator 5 to detect a load on the generator 5, i.e. a load rate on the turbine 4.

The apparatus also has a pressure detecting means for detecting the data II which represent the pressures at the inlets of the feedwater pumps 34*a*, 34*b* and 34*c*. In this case, the pressure detecting means includes pressure transmitters 2*a*, 2*b* and 2*c* which are provided on the suction pipes 33*a*, 33*b* and 33*c*, respectively to detect the pressure at the inlets of the feedwater pumps.

The apparatus further has a temperature detecting means for detecting the data III representing the water temperatures at the inlet side of the feedwater pumps 34*a*, 34*b* and 34*c*. The temperature detecting means includes feedwater temperature detectors 3*a*, 3*b* and 3*c* which are disposed at the downstream sides of the pressure transmitters 2*a*, 2*b* and 2*c* to detect the feedwater temperatures in the respective suction pipes of the feedwater pumps.

An example of the process for determining the load on the turbine will be explained hereinunder with reference to FIG. 2.

The reduction rate $L_X$ in the turbine load is computed by a load reduction rate computing section 1.2 in the computing means 1 on the basis of the detected turbine load Lo, the demand load L which represents the level to which the turbine load is to be reduced, and the time t during which the turbine load has to be reduced, in accordance with the following formula.

$$L_X = \frac{L_o - L}{t} \times 100 \text{ (\%/sec)}$$

Figure 2:
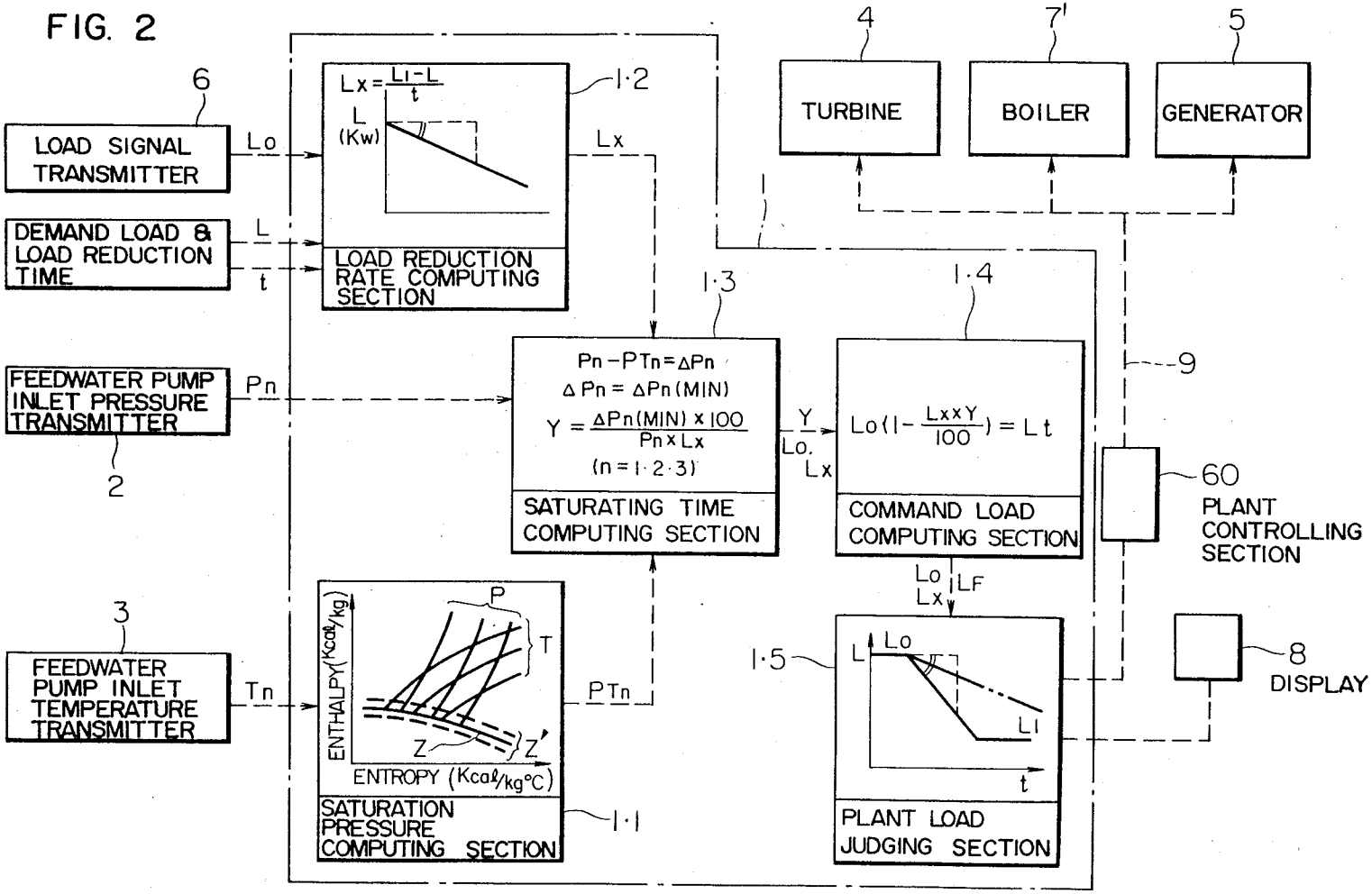
FIG. 2 illustrates a process for determining the load on the turbine.

The computing means 1 further includes a saturation pressure computing section 1.1 which computes the saturation pressure $P_{Tn}$ on the basis of the temperature Tn (n=1, 2, 3) of the water in the feedwater pump suction pipes, detected by the feedwater pump inlet temperature transmitter 3 (see FIG. 2). This computation is done with reference to the Enthalpy-Entropy chart (Mollier chart) which is stored in the section 1.1. The saturation pressure $P_{Tn}$ is determined as the point at which the detected feedwater temperature Tn crosses the saturation limit line Z in the Mollier chart. In some cases, a certain margin is assumed on the saturation limit line Z. In such a case, a certain area is assumed as denoted by broken lines Z' in the chart. The region above the line Z is the region where the flashing occurs, whereas the region below the line Z is the region in which the flashing cannot occur. Therefore, the flashing can be avoided safely if the saturation pressure computing section determines a value below the point of crossing with the line Z as a saturation pressure.

The computing means further has a saturation time computing section 1.3 which determines the time duration Y until the saturation pressure is reached, through computation of the pressure difference ΔPn (n=1, 2, 3). The pressure difference ΔPn is computed on the basis of the load reduction rate $L_X$ and the saturation pressure $P_{Tn}$ computed as above, as well as the feedwater pump inlet pressure Pn (n=1, 2, 3) from the feedwater pump inlet pressure transmitter 2 (see FIG. 2), in accordance with the following formula.

$$\Delta Pn = Pn - P_{Tn} \text{ (n=1, 2, 3)}$$

The computing means also has a function to determine the smallest ΔPn (MIN) among three pressure differences ΔPn's. This means to select a feedwater suction pipe 33*a*, 33*b* or 33*c* which has the greatest possibility of the occurrence of flashing (see FIG. 1). The selection of the smallest pressure difference, however, is not always necessary. Namely, if no problem is expected in the feedwater pump operation, the smaller one among the pressure difference except the pressure difference not to be considered is used for the determination of the feedwater suction pipe in which the flashing is most likely to occur.

The time Y is computed using the selected smallest pressure difference ΔPn(MIN), feedwater pump suction pressure Pn (n=1 or 2 or 3) and the load reduction rate $L_X$. Since the pressure in the deaerator and the feedwater pump suction pressure are reduced at the rate substantially equal to the turbine load reduction rate, the pressure reduction rate can be expressed as ($L_X \times Pn$).

$$Y = \frac{\Delta Pn(\text{MIN}) \times 100}{Pn \times L_x} \text{ (sec) } (n = 1, 2, 3)$$

The determined saturating time Y is the time duration in which the flashing does not occur when the turbine load is reduced at the load reduction rate computed by the load reduction rate computing section 1.2. The turbine load $L_Y$ at such time is expressed as follows.

$$L_Y = L_o\left(1 - \frac{Y \times L_X}{100}\right) \text{ (KW)}$$

After the computation, the command load $L_Y$ is inputted to a plant operation load pattern judging section 1.5, in which a manner of reduction of the turbine load is determined on the basis of the command load, i.e., the optimum desired load, $L_Y$ and the load reduction rate $L_X$.

If the obtained command load $L_Y$ is below the demand load L, the turbine load is reduced at the load reduction rate $L_X$ computed in the section 1.2 down to the demand load L. Conversely, when the command load $L_Y$ is greater than the demand load L, the turbine load is not reduced to the demand load L, but to the command load $L_Y$. If the load is born by only one plant, the load is reduced once down to the command load and then the load is further reduced again after the temperature in the downcomer pipe comes down, or the hot water in the downcomer pipe is displaced to avoid any possibility of flashing. When the load is born by a plurality of plants, some of the plants are stopped safely while other plants continue to operate to bear the load. For instance, assuming here that the total load which has been born by two plants has to be reduced from 100% to 50%, the control is conducted not in a manner to reduce the load level down to 50% in each plant but in such a manner as to stop one of the plants safely and to operate the other plant at 100% load to meet the demand for 50% reduction of the total load. This control is conducted by a plant controlling section 60 either manually by an operator in accordance with the result of the judgement in the plant load judging section displayed on the display 8 or automatically.

The described control can be applied directly to the case where there is only one downcomer pipe. In the case where the pumps 34*a*, 34*b* and 34*c* are connected directly to the deaerator 21 unlike the arrangement shown in FIG. 1, the group including the stopped pump is omitted from the consideration in some cases.

As has been described, the plant operation controlling method in accordance with the invention can be carried out fully automatically by arranging such that the plant load is controlled in accordance with a plant starting or stopping instruction which is produced on the basis of the result of computation by the computing means 1.

The function and the storage memory required for the computing means 1 are rather small, so that a small-capacity computer which is rather inexpensive can be used only for this purpose. Alternatively, since the required capacity is rather small, suitable vacancy or surplus capacity of the large-capacity computer used for the control and observation of the whole plant may be used for the construction of the computing means 1.

Figure 3:
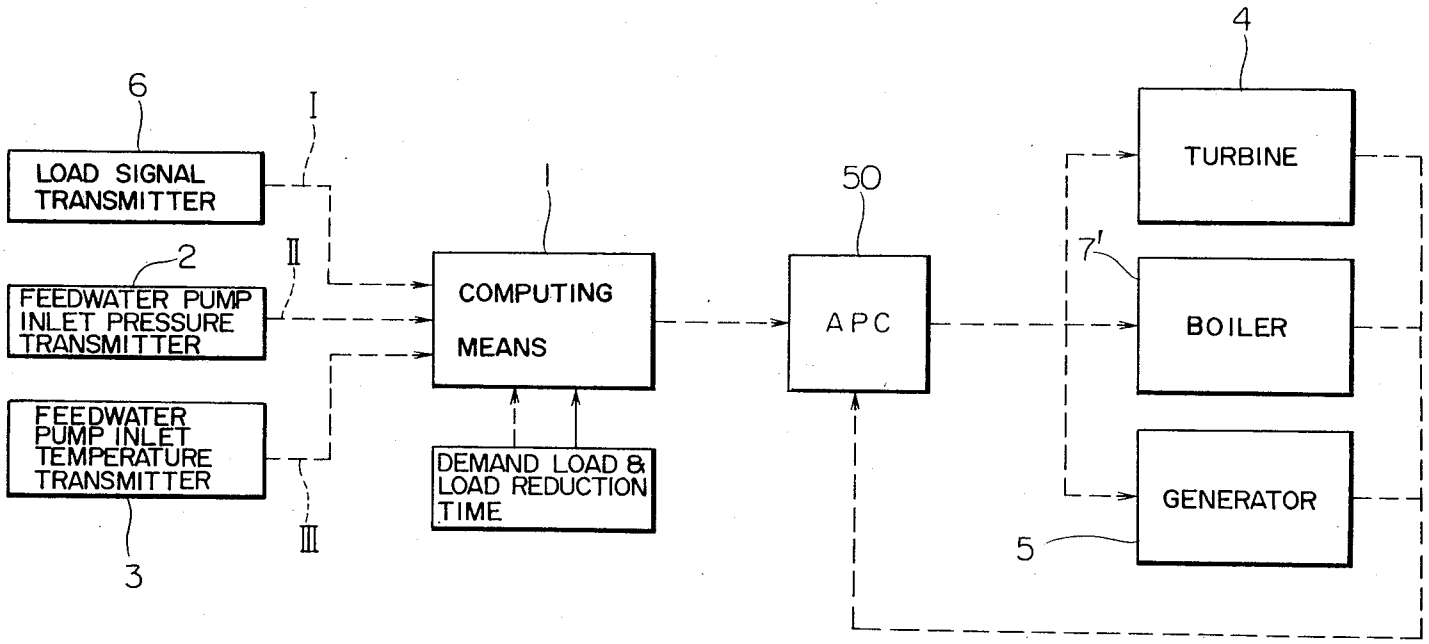
FIG. 3 is an illustration of the principle of the controlling method in accordance with the invention.

FIG. 3 is an illustration of the principle of the controlling method of the invention, which is conducted fully automatically. The data I, II and III derived respectively from the generator load transmitter 6, feedwater inlet pressure transmitter 2 and the feedwater pump inlet temperature transmitter 3 are delivered to the automatic computing means 1 which performs the above-mentioned computation such as to determine the command load $L_F$ and the load reduction rate $L_X$. The determined command load $L_F$ and the load reduction rate $L_X$ are inputted to an APC (Automatic Plant Control) 50 which controls the operations of the turbine 4, the boiler 7' and the generator 5 in accordance with the inputted values.

The states of operation of the plant, i.e., of the boiler, the turbine and the generator which are varied by the APC 50 are fed back to the APC 50. On the other hand, the load on the generator, i.e., the load on the turbine plant, after being changed by the operation of the APC 50, are fed back to the generator load transmitter 6 again. This feedback is materially equivalent to the feedback to the computing means 1. Then, the computing means 1 again computes a command load $L_Y$, and the process explained above is conducted again to reduce the turbine load in accordance with the newly computed command load $L_Y$ and the load reduction rate $L_X$.

Thus, the initially judged command load $L_Y$ and the load reduction rate $L_X$ are fed back and judged and determined as being adequate values. Therefore, as this process is repeated, the optimum values are determined. Although various patterns determined by the command load level and the load reduction rate are available, the above-described feedback method offers the optimum pattern. In general, where a temperature is given, there is a certain relationship between the load and the pressure for avoiding occurrence of flashing. In other words, the level of pressure required at a certain level of load in order to avoid the flashing may be determinable. This relationship, however, may vary depending on the command load $L_Y$ and the load reduction rate $L_X$. In addition, the temperature is not fixed but is variable. Therefore, it is the most reasonable way to determine the optimum value by the feedback method explained hereinbefore.

Figure 4:
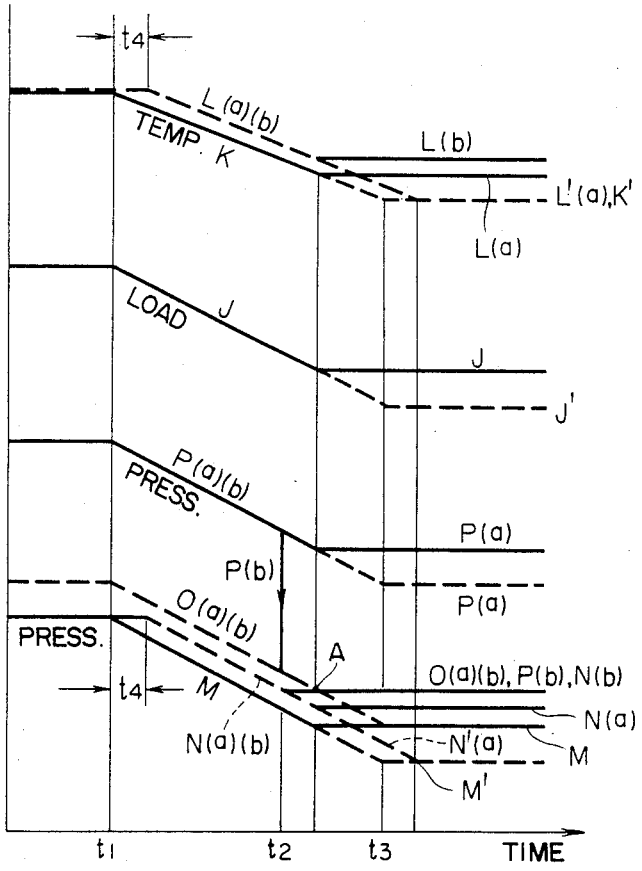
FIGS. 4 and 5 are diagrams showing changes in the temperature and pressure in relation to time, as observed in an embodiment of the invention.

Referring now to FIG. 4, assuming here that the feedwater pump inlet temperatures L(a)(b) start to come down with a time lag $t_4$, the saturation pressure N(a)(b) of water corresponding to the feedwater pump inlet temperature starts to come down. Then, as the plant load J is decreased below 50%, the feedwater pump 34*b* is stopped as explained before. The moment at which this pump is stopped is represented by $t_2$. If the turbine load J is further reduced from the moment $t_2$ to the moment $t_3$, the booster pump inlet pressure O(a)(b) also goes on to be reduced till the moment $t_3$. On the other hand, the inlet pressure P(a) of the feedwater pump 34*a* which is still operating is reduced along a line substantially parallel to the line M representing the pressure in the deaerator. Since the booster pump 32*b* (see FIG. 1) is stopped simultaneously with the stopping of the feedwater pump 34*b*, the pressure difference between the outlet and the inlet of the booster pump 32*b* is nullified, so that the pressure P(b) of the inlet of the feedwater pump 34*b* is lowered drastically and laps the inlet pressure O(a)(b) of the booster pump 32*b* after the moment $t_2$. Thus, the inlet pressure P(b) of the feedwater pump 34*b* is abruptly lowered but the inlet temperature L(b) of this pump is maintained substantially constant after the moment $t_2$ as a result of stopping of this pump. Consequently, the saturation pressure N(b) corresponding to the feedwater pump inlet temperature also is maintained substantially constant after the moment $t_2$. In consequence, the inlet pressure P(b) of the feedwater pump 34*b* comes equal to the saturation pressure N(b) corresponding to the inlet temperature of this pump at a point A and, thereafter, comes down below the saturation pressure N(b), so that the feedwater in the suction side of the feedwater pump 34*b* flashes undesirably. It will be understood how the flashing takes place when one pump 34*b* of two feedwater pumps is stopped in response to a reduction in the plant load J.

Figure 5:
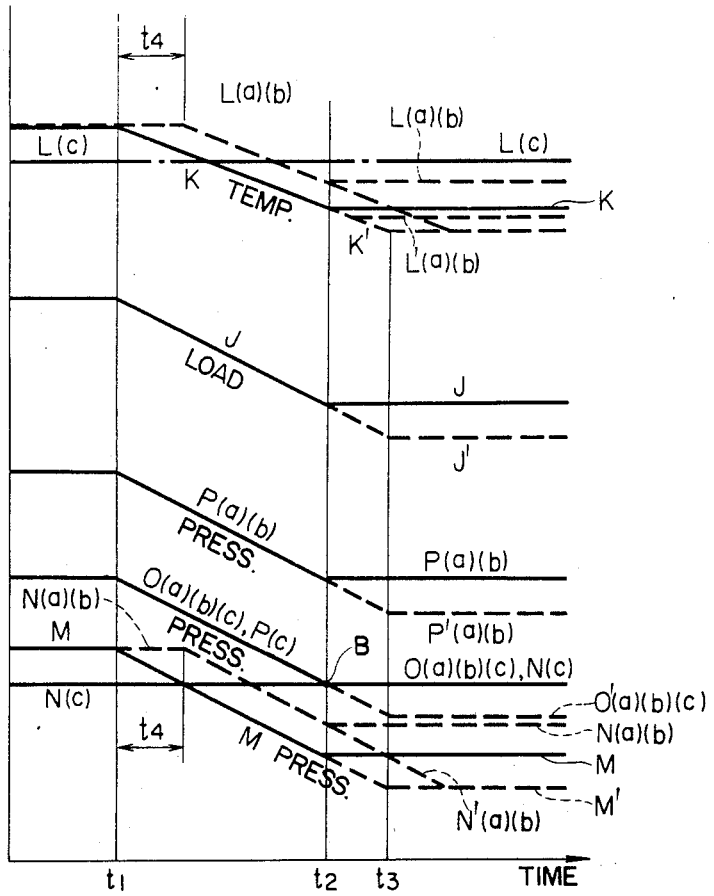

Referring now to FIG. 5, a line L(c) represents the temperature at the inlet side of the feedwater pump 34*c* which is stopped, while a line N(c) represents the saturation pressure of water corresponding to the temperature at the inlet side of the feedwater pump 34*c*. In this case, since the feedwater pump 34*c* has been stopped, the feedwater stagnates in the downcomer pipe 23*c* and the suction pipe 33*c* of the feedwater pump 34*c* and the temperature thereof is maintained at a substantially constant level below the temperature of the water stored in the deaerator, even though the plant load J is changed from the moment $t_1$ to $t_2$.

In consequence, at a point B, the inlet pressure P(c) of the feedwater pump 34c and the booster pump inlet pressure O(c) become equal to the saturation pressure corresponding to the temperature at the inlet side of the feedwater pump 34c and, thereafter, comes down below the saturation pressure N(c), thus allowing the flashing of the feedwater in the suction pipe of the feedwater pump 34c.

The reason why the flashing takes place has been described. It will be understood from the foregoing explanation that the greater the absolute value of the load reduction and the rate of load reduction become, the larger the possibility of flashing is.

In order to avoid the occurrence of flashing, according to the invention, the computing means 1 produces, upon receipt of the detected values corresponding to the pressures and temperatures in the downcomer pipes, an output which serves to maintain, in the period after the point A, the plant load at the same level as the load attained at the point A.

As a result of such a control, referring to FIG. 4, the inlet pressure P(b) of the feedwater pump 34b becomes equal to the saturation pressure N(b) corresponding to the inlet temperature of this pump and is maintained at the same level in the period after the point A. In the case of FIG. 5, the inlet pressure P(c) of the feedwater pump 34c becomes equal to the saturation pressure N(c) corresponding to the inlet temperature of this pump, and this pressure is maintained in the period after the point B.

It will be seen that the occurrence of flashing is avoided insofar as the saturation pressure corresponding to the inlet temperature and the inlet pressure of the feedwater pump, in accordance with the controlling method of the invention described hereinbefore.

As has been described, according to the invention, it is possible to prevent the occurrence of flashing in the deaerator and downcomer pipes at the time of reduction in the load on the turbine of a steam turbine plant. Although the invention has been described with reference to the case where only one steam turbine plant is used for bearing the load, it will be clear to those skilled in the earth that the invention is applicable to the case where two or more plants are used to bear the electric power generating load.

What is claimed is:

1. A method of controlling an operation of a turbine plant on a reduction of the load on a turbine, said turbine plant including a condenser for condensating the steam extracted from said turbine, a deaerator for deaerating a condensate from said condenser, feedwater pumps for supplying the deaerated feedwater to a boiler which evaporates the feedwater and supplies the steam to said turbine, and downcomer pipes through which said feedwater pumps are connected to said deaerator, said method comprising: measuring a load on said turbine and a pressure and a temperature of the feedwater in said downcomer pipes; computing an operational turbine load by means of computing means in accordance with the measured values, a demand load and a time duration in which the load has to be reduced; and controlling the load on said turbine while maintaining the pressure in said downcomer pipes higher than the saturation pressure corresponding to the temperature in said downcomer pipes.

2. A method according to claim 1, wherein a plurality of series connection of said feedwater pump and said downcomer pipes are arranged in parallel to each other.

3. A method according to claim 1, wherein said turbine plant has a steam pipe for introducing a heated steam from said turbine to said deaerator.

4. A method according to claim 1, wherein said downcomer pipes are provided with booster pumps.

5. A method according to claim 1, wherein the pressures at the inlet sides of said feedwater pumps are measured as said pressures in said downcomer pipes.

6. A method according to claim 1, wherein said pressure of feedwater in said downcomer pipe is determined by measuring the flow rate of feedwater, the number of revolutions or the shaft power of said feedwater pump, and by using the measured values and a water head.

7. A method according to claim 1, wherein the computation by said computing means includes: determining the rate of reduction in the load on the turbine from the detected load on said turbine, said demand turbine load and said load reduction time duration; determining a time duration until the pressures in said downcomer pipes come down to a saturation pressure at the time of reduction in the load on said turbine, by using said rate of reduction of load on said turbine, pressures in said downcomer pipes and the saturation pressure computed from the temperature in said downcomer pipes; determining a command load to which the turbine load can be lowered after said time duration while maintaining the pressures in said downcomer pipes above said saturation pressure; and determining the reduction in the load on said turbine in accordance with the determined command load.

8. A method of controlling an operation of a turbine plant on a reduction of the load on a turbine, said turbine plant including a condenser for condensating the steam extracted from said turbine, a deaerator for deaerating a condensate from said condenser, feedwater pumps for supplying the deaerated feedwater to a boiler which evaporates the feedwater and supplies the steam to said turbine, and downcomer pipes through which said feedwater pumps are connected to said deaerator, said method comprising: measuring a load on said turbine and a pressure and a temperature in said downcomer pipes; computing an operational turbine load in by means of computing means in accordance with the measured values, a demand load and a time duration in which the load has to be reduced; and controlling the load on said turbine while maintaining the temperature in said downcomer pipes lower than the saturation temperature corresponding to the pressure in said downcomer pipes.

9. An apparatus for controlling an operation of a turbine plant including a condenser for condensating the steam extracted from a turbine, a deaerator for deaerating a condensate from said condenser, feedwater pumps for supplying the deaerated feedwater to a boiler which evaporates the feedwater and supplies the steam to said turbine, and downcomer pipes through which said feedwater pumps are connected to said deaerator, said apparatus comprising: means for detecting a load on said turbine; means for detecting pressures in said downcomer pipes; means for detecting temperatures in said downcomer pipes; means for computing an operational load on said turbine from the values detected by said detecting means, a demand load and a time duration in which the load has to be reduced; and means for controlling the load on said turbine in accordance with the result of the computation by said computing means such as to maintain the pressure in said downcomer pipes higher than the saturation pressure corresponding to the temperature in said downcomer pipes.

10. An apparatus according to claim 9, wherein a plurality of series connection of said feedwater pump and said downcomer pipes are arranged in parallel to each other.

11. An apparatus according to claim 9, wherein said turbine plant has a steam pipe for introducing a heated steam from said turbine to said deaerator.

12. An apparatus according to claim 9, wherein said computing means has a section for computing the rate of reduction of load on said turbine, a section for computing a saturation pressure, a section for computing a time duration in which the pressures in said downcomer pipes are reached said saturation pressure, a section for computing a command load on said turbine, and a section for judging an operational load on said plant.

13. An apparatus according to claim 12, wherein the value computed by said turbine load detecting means is inputted to said load reduction rate computing section.

14. An apparatus according to claim 12, wherein the values detected by said means for detecting the pressures in said downcomer pipes are inputted to said time duration computing section.

15. An apparatus according to claim 12, wherein the value detected by said means for detecting the temperature in said downcomer pipes is delivered to said saturation pressure computing section.

16. An apparatus according to claim 12, wherein said time duration computing means conducts the computation by using the load reduction rate computed by said load reduction rate computing section, the detected pressures in said downcomer pipes and the saturation pressure computed by said saturation pressure computing section.

17. An apparatus according to claim 12, wherein said command load computing section conducts the computation by using the result of computation performed by said time duration computing section.

18. An apparatus according to claim 12, wherein said operational load judging section conducts the computation by using the result of computation performed by said command load computing section.

* * * * *